US005257303A

United States Patent [19]

Das Gupta

[11] Patent Number: 5,257,303

[45] Date of Patent: Oct. 26, 1993

[54] SURFACE CHANNELED X-RAY TUBE

[76] Inventor: Kamalaksha Das Gupta, 2918 69th St., Lubbock, Tex. 79413

[21] Appl. No.: 923,827

[22] Filed: Aug. 3, 1992

[51] Int. Cl.[5] ..... H01J 35/08

[52] U.S. Cl. ..... 378/85; 378/84; 378/124; 378/143

[58] Field of Search ..... 378/82, 84, 85, 119, 378/121, 124, 143

[56] References Cited

U.S. PATENT DOCUMENTS

| | | | |
|---|---|---|---|
| 3,525,863 | 8/1970 | Constantine et al. | 378/124 |
| 3,925,660 | 12/1975 | Albert | 378/124 |
| 3,983,397 | 9/1976 | Albert | 378/124 |
| 4,000,433 | 12/1976 | Rohmfeld | 378/143 |
| 4,048,496 | 9/1977 | Albert | 378/124 |
| 4,205,251 | 5/1980 | Zwep | 378/143 |
| 4,260,885 | 4/1981 | Albert | 378/124 |
| 4,894,852 | 1/1990 | Das Gupta | 378/119 |

OTHER PUBLICATIONS

Diffraction Phenomena When the Source of Radiation Lies Within the Crystal, *The Optical Principles of the Diffraction of X-Rays,* R. W. James, G. Bell & Sons Ltd., (1958) pp. 438, 439 and 457.

The Borrmann Effect, Crystal Optics for Visible Light and X-Rays, *Review of Modern Physics,* P. P. Ewald, vol. 37, No. 1, Jan. (1965) pp. 46, 53-55.

Non Linear Increase in Bragg Peak and Narrowing of X-Ray Lines *Physics Letters,* K. Das Gupta, vol. 46A, No. 3, Dec. 17, (1973), pp. 179-180.

Stimulated X-Ray Fluorescence From Excited Crystals *Proceedings of SPIE—The International Society for Optical Engineers,* K. Das Gupta, vol. 743, Jan. (1987), pp. 49-51.

Mahendra Lal Sircar Lecture (part-I) Delivered at the Indian Association for the Cultivation of Science on Jan. 3, 1984. by K. Das Gupta.

Non-Linear Increase in Bragg Peak and Narrowing of X-ray Lines by K. Das Gupta.

Studies of the Non-Linear Rise in Intensity of X-Ray Lines by K. Das Gupta, A. A. Bahgat and P. J. Seibt.

"Coherent emission of characteristic lines on passage of charged particles through a single crystal" 1976 American Institute of Physics by S. A. Akhmanov and B. A. Grishanin.

Coherent y-Emission by Stimualted Annihilation of Electron-Positron Pairs, by M. Bertolotti and C. Sibilia, Appl. Phys. 19, 127 130 (1979).

*Primary Examiner*—David P. Porta

*Attorney, Agent, or Firm*—William W. Haefliger

[57] ABSTRACT

A beam generating apparatus the combination comprising a first binary alloy target crystal consisting essentially of an alloy of copper and silver, for producing a primary x-ray beam; a second target crystal consisting essentially of copper in the path of the first x-ray beam and oriented to produce a CuKα, radiation in response to impingement of the primary beam.

26 Claims, 5 Drawing Sheets

SURFACE CHANNELED X-RAY TUBE

BACKGROUND OF THE INVENTION

This invention relates to the production of a novel x-ray source using dual targets as in an alignment producing a parallel monochromatic beam through the exit window of an x-ray tube.

There is a perceived need for an improved x-ray source to obtain an overall improvement in x-ray diffraction work and other applications. Conventional x-ray sources with poor signal to noise ratios are inefficient as respects weaker diffraction structures and sensitivity in x-ray imaging devices, due to associated bremsstrahlung noise.

SUMMARY OF THE INVENTION

The objective of this invention is to provide method and means to circumvent and satisfy the perceived need as referred to. The method of the invention basically employs a first binary alloy flat target of crystal elements Z and Z'. This target is critically aligned relative to a monocrystal flat planar face second target. The method includes the steps:

(a) exciting the binary alloy (Z,Z') flat target face by a line focus electron beam of variable width and intensity, (b) aligning a collimator to isolate an intense x-ray beam emitting at a grazing angle from the polycrystalline target face, (c) aligning a second target crystal Z face with respect to the collimated beam from the polycrystalline homogenous binary alloy target, to produce beam striking of the crystal Z at Bragg angle $\Theta_b$ for producing K$\alpha$ of element Z as the output beam.

In this regard, the binary alloy target simultaneously pumps and induces the fluorescing of the single crystal target Z. Also, a narrow platinum slit may be attached to the exit beryllium window of the device to obtain a clear K$\alpha$ line, without instrumental scattering of radiation, for precision diffraction work and other applications.

Another object is to provide beam generating apparatus comprising, in combination a) a first binary alloy target crystal consisting essentially of an alloy of copper and silver, for producing a primary x-ray beam, b) a second target crystal consisting essentially of copper in the path of said first x-ray beam and oriented to produce a CuK$\alpha$ radiation in response to impingement of said primary beam.

As will be seen the proportions of copper and silver in the first target are preferably, in terms of atomic weight, about 50% copper and about 50% silver. Further, the second target may consist of Cu(111), or Cu(200), or two such second targets may be provided as will appear.

A further object is to provide the second target oriented to produce Kossel radiation directed at angle $\Theta_b$ relative to said face, and Borrmann radiation directed at angle $2\Theta_b$ relative to said face.

Yet another object is to provide beam generating apparatus including a) a first multiple alloy target crystal for producing
   i) a primary x-ray beam
   ii) a secondary x-ray beam b) a primary target crystal in the path of said primary x-ray beam to produce Kossel radiation in a beam $K_1$, and Borrmann radiation in a beam $B_1$, c) and a secondary target crystal in the path of said secondary x-ray beam to produce Kossel radiation in a beam $K_2$ and Borrmann radiation in a beam $B_2$.

These and other objects and advantages of the invention, as well as the details of an illustrative embodiment, will be more fully understood from the following specification and drawings, in which:

DRAWING DESCRIPTION

FIG. 1*a* is a diagram showing nearly unrestricted flow along crystal planes, of characteristic x-ray photons as Borrmann channeling;

FIG. 1*b* is a diagram showing a new observation of Bragg-Borrmann surface channeling of characteristic K$\alpha_1$ x-rays;

FIG. 1*c* shows focusing of K$\alpha_1$ Kossel photons of crystal element Z induced by x-rays from a crystal Z';

FIG. 1*d* is a diagram showing production of a sharp Kossel photon line from crystal element Z pumped by x-rays from a binary alloy target of crystal elements Z and Z';

Figure 4A:
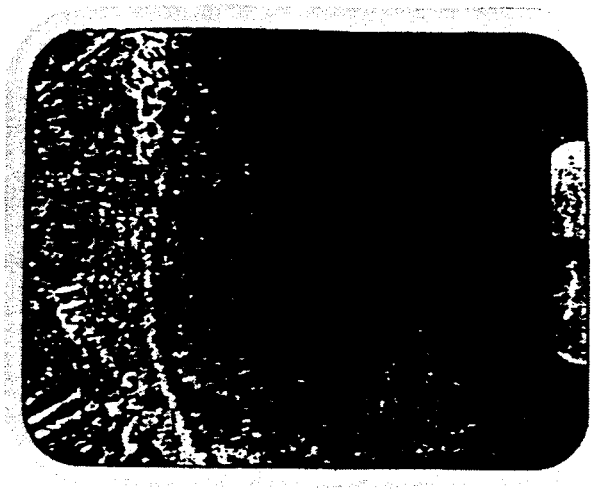
Figure 5:
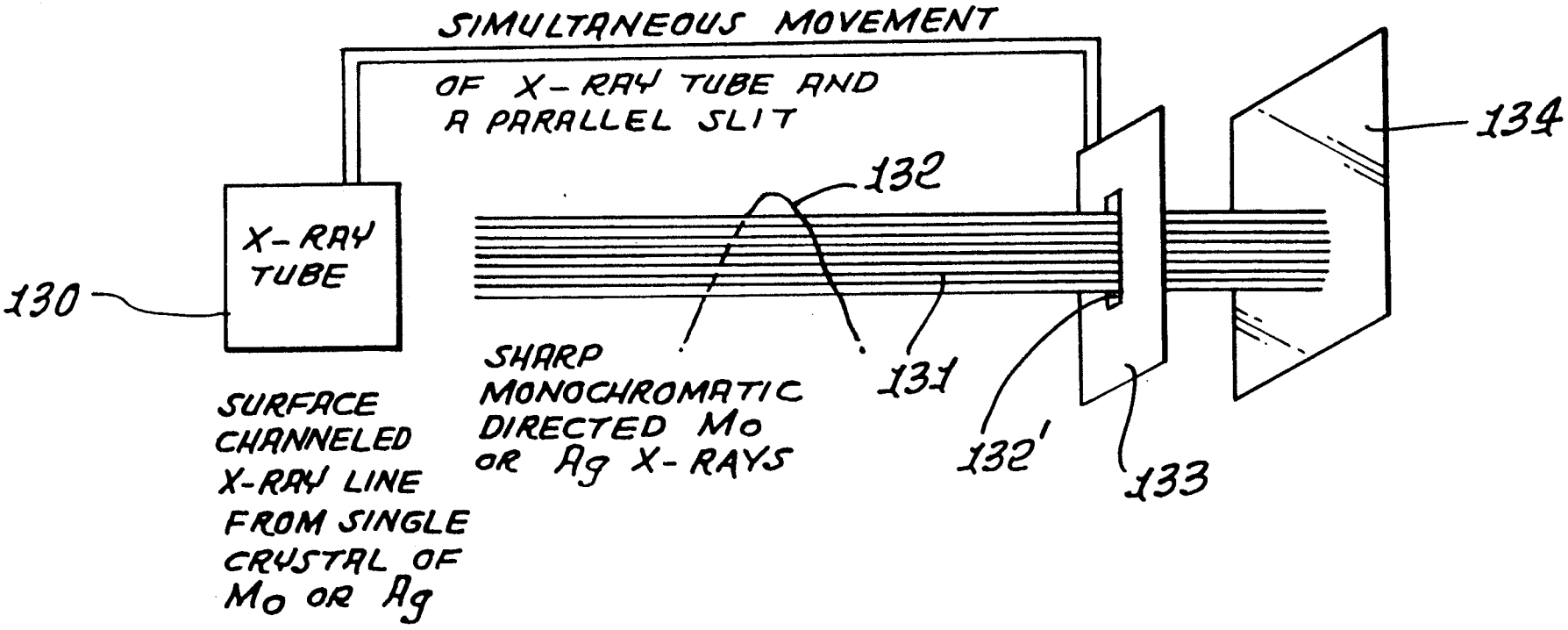

FIGS. 4*a* and 5*b* show x-ray diffraction of silicon powder using a surface channeled x-ray tube; and FIG. 5 shows scanning x-ray mammogram apparatus.

DETAILED DESCRIPTION

Figure 1A:
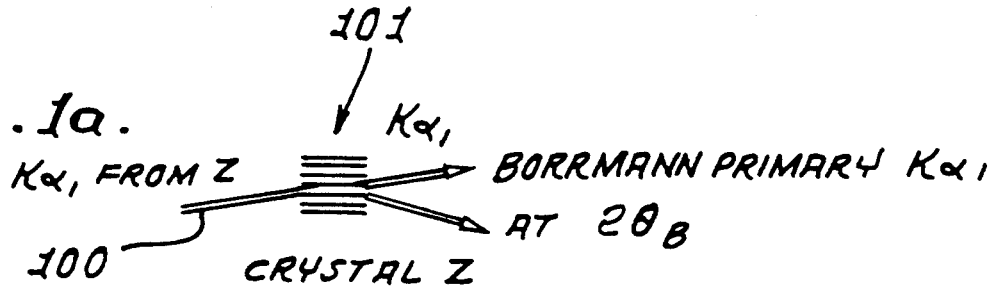
Figure 3:
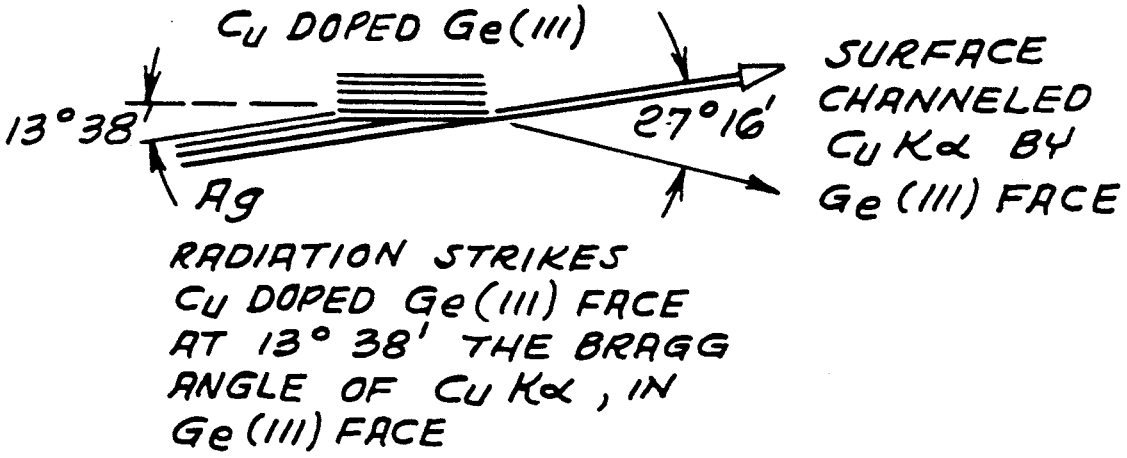
FIG. 3 shows a stimulated x-ray fluorescence of CuK$\alpha_1$ from excited copper atoms doped in a Ge monocrystal.

FIG. 1*a* is an illustration of the prior art transport of a collimated beam 100 of characteristic K$\alpha_1$, photons of or from a crystal target element Z, through a single crystal of the lasing lattice crystal 101. G. Borrmann (1950) reported that at the Bragg angle $\Theta_b$, CuK$\alpha$ photons are transmitted through a crystal of calcite of thickness 2.7 mm., and the reduction in intensity was surprisingly less by a factor of $10^8$. Applicant herein has used a germanium crystal doped with copper and observed CuK$\alpha$ photons by surface channeling through excited copper atoms doped in Ge crystal. See FIG. 3. A beam of CuK$\alpha$ is surface channeled through Ge(111) planes at the Bragg angle of 13°38' with an enhanced intensity similar to Borrmann effect as surface Borrmann.

Figure 1B:
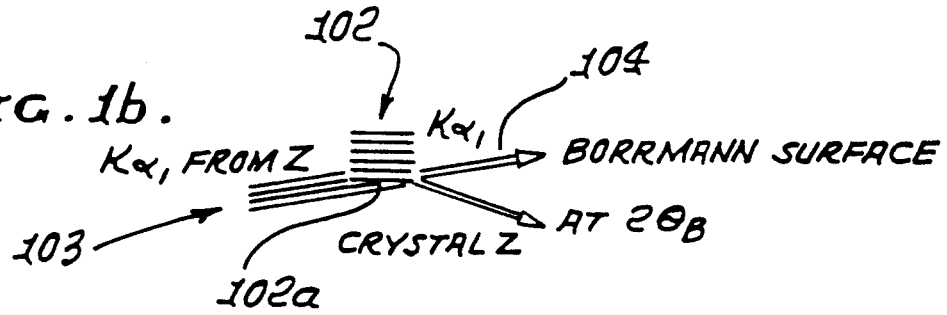

Referring to FIG. 1*b*, illustrating the present invention, it shows use of a single crystal 102 of Cu(111) with its face 102*a* set at Bragg angle of $\Theta = 21 + 30'$ relative to incident radiation 103. A sharp CuK$\alpha_1$ emitted beam 104 is parallel to the direction of the collimated beam 103 of CuK$\alpha$ radiation striking face 102*a* of Cu(111) crystal 102.

Applicant has used a collimated beam of x-rays from a Mo target x-ray tube, and in another experimental setup, x-rays from a Ag target x-ray tube strike the face of a single crystal of Cu(111). The collimated beam from either the Mo or Ag tube strikes the Cu crystal at the same angle $\Theta = 21°39'$. In each case, a sharp CuK$\alpha_1$ line is emitted from the edge of the Cu(111) crystal face. This is a clear demonstration of induced emission of CuK$\alpha_1$ Kossel radiation standing modes stored in an x-ray pumped Cu(111) crystal face.

Figure 1C:
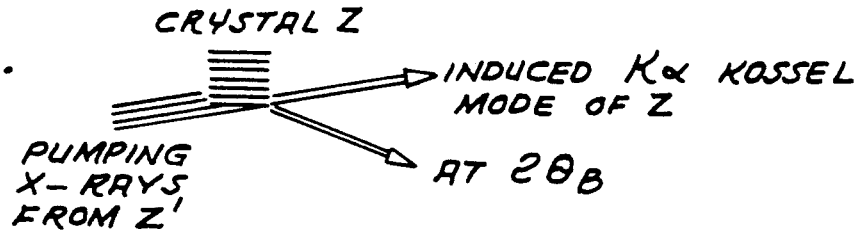
Figure 1D:
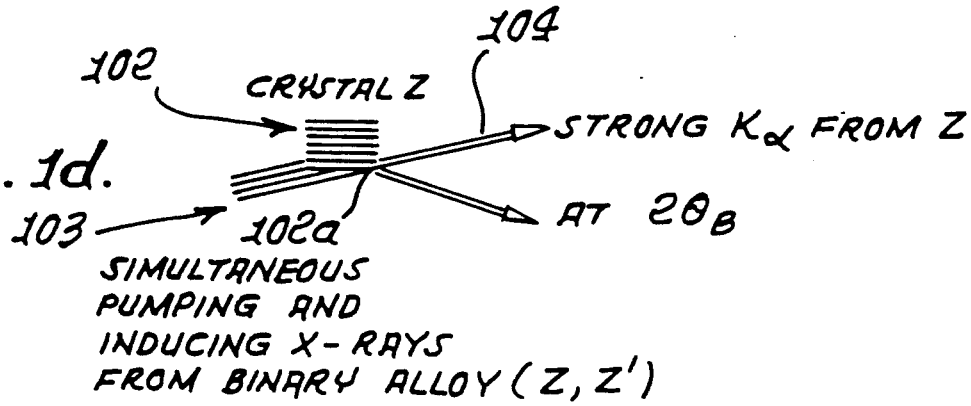
Figure 2:
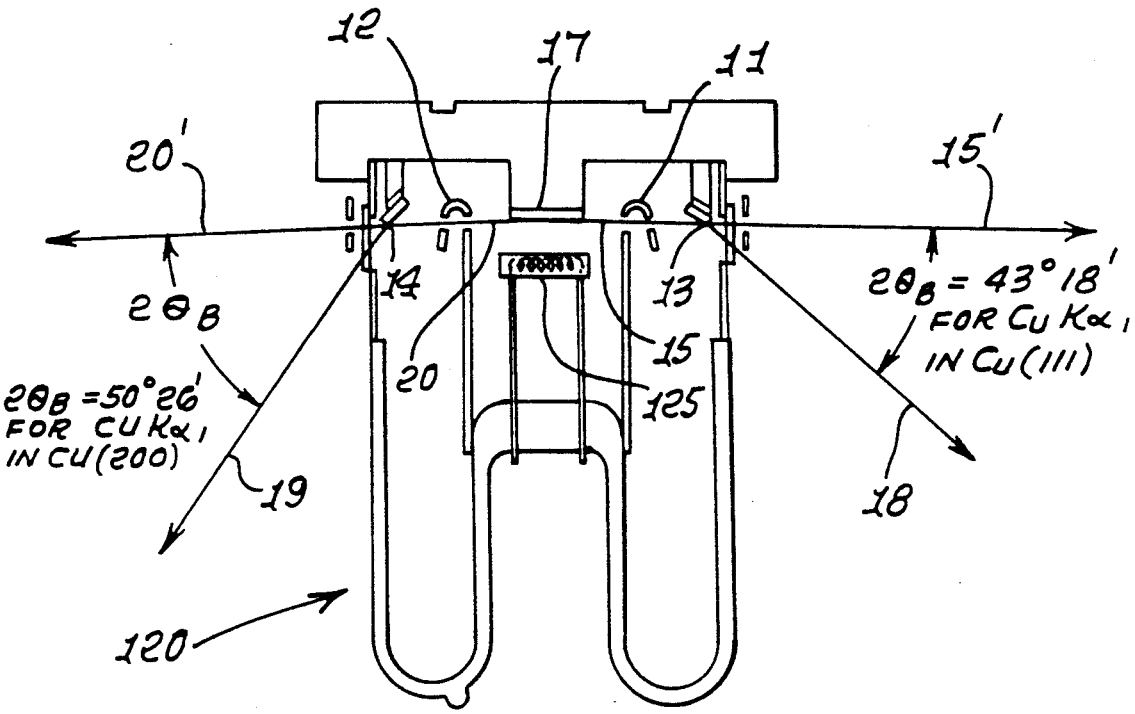
FIG. 2 shows a surface channeled x-ray tube.

In FIG. 1*d*, the x-ray tube, of the type shown in FIG. 2, employs a binary alloy target (not shown) of Ag and Cu in the same atomic proportions. In this case, Ag- $K\alpha+K\beta$ beams as at 103 serve to ionize most effectively the target Cu crystal 102 and the surface Borrmann type channeling releases the $CuK\alpha$ Kossel mode radiation 104 already stored in the Cu crystal being pumped by Ag x-rays. In the absence of an x-ray tube with binary alloy of Ag and Cu, a fine capillary Cu tube in the collimator of the Ag target x-ray may be employed to provide a higher percentage of $CuK\alpha$ fluorescence from the inner surface of the capillary Cu tube.

For a Cu x-ray tube (i.e. the secondary target), the binary alloy first target is typically an alloy of Cu and Ag; and for an iron second target x-ray tube, the binary alloy (first) target is Fe and Cu alloy. Such specific binary alloys for Ti, Cr, Co, Cu, Mo, Ag x-ray tubes have been formulated for near resonance pumping by x-rays from the Z' element of the binary alloy. Such single crystals of the pure metal targets for lasing are commercially available.

FIG. 2 is a schematic showing of a modified x-ray diffraction tube 120. The binary alloy first target 17 produces x-ray beams 15 and 20 which pass at a grazing angle through collimators 11 and 12. The collimated beam 15 strikes the face of single crystal of second target Cu(111) at 13, at Bragg resonance angle 21°39'. The collimated beam 20 strikes the face of second target Cu(200) at 14, at 25°13', which is the Bragg angle of $CuK\alpha_1$in Cu(200). Surface channeled x-rays of $CuK\alpha_1$ are ejected as beam 15' coinciding with, i.e. parallel to, the direction of the collimated beam 15. A second reflected beam appears at 18 as in a Borrmann process at angle $2\Theta_b=43°18'$ relative to 15. A reflected beam from Cu(200) at 14 appears at 19 at an $CuK\alpha_1$ from Cu(200) directed at 20' parallel to 20.

In FIG. 2, an electron gun 125 produces an electron beam incident on target 17 to produce beams 15 and 20, as described.

Figure 4B:
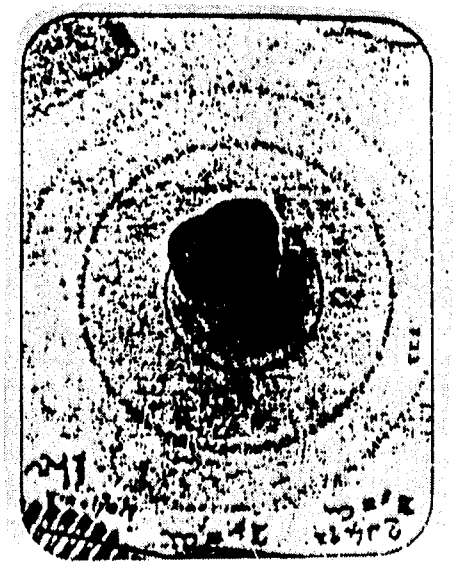

The surface channeled dual target x-ray tube of this invention produces sharp diffraction lines from silicon powder and graphite powder with a dramatic increase of signal to noise ratio, which is evident from nearly no background x-ray diffraction rings even after 2 hours of exposure at 40 KV, 10mA. See FIG. 4(*b*). The same experimental set up using a fine focus Philips x-ray tube at the same operating voltage 40 KV and same tube current of 10 mA produces a much higher degree of background scattering. See FIG. 4(*a*). Applicant has also observed sharp x-ray diffraction rings (produced by the surface channelled dual target x-ray tube) of graphite at 15 KV, 10 mA. Accordingly, the new x-ray tube operates to give good powder diffraction patterns at 150 Watts input power.

A very thin coating of tungsten deposit from the electron gun onto the Cu target face also emits $WL_b$ along with $CuK\alpha$ radiation. Again the $WL_b$ photons ionize effectively K-shell electrons of atoms of Cu of single crystal of Cu face (111). To improve the rate of ionization, the electron gun filament can be changed to iridium, since iridium L radiation is immediately above K ionization of Cu atoms in Cu-x-ray tube.

A single crystal of copper face (111) has been mounted close to a Mo first target x-ray tube.

A single crystal of copper face (111) has been mounted close to a Mo first target x-ray tube. X-rays emitted from the flat Mo target at grazing angle less than 1° take off strikes the face (111) of the single crystal of Cu at the exit edge of x-rays from Cu(111) face. X-rays from a Mo target ionize K-shell electrons of Cu-atoms at the surface layer of face of the copper (111) single crystal. The collimated beam from the Mo x-ray tube strikes the Cu(111) crystal at 21°39', the Bragg angle of $CuK\alpha$ relative to crystal planes of Cu(111). A sharply focussed $CuK\alpha_1$ line appears coinciding with the direction of the collimated pumping x-ray beam from the Mo x-ray tube, FIG. 1*c*. The extended Kossel lines due to (111) planes of the excited Cu single crystal are focussed to a narrow sharp line of $CuK\alpha_1$ due to stimulation. This copper line is a directed emission of a Kossel cone due to induced emission by the same frequency of $CuK\alpha_1$ from Mo bremsstrahlung.

When a capillary Cu-tube of inner diameter 0.4 mm is set to collimate Mo target x-rays, the x-ray beam from the Mo target is superposed to $CuK\alpha$ fluorescence x-rays from the inner Cu surface of Cu-capillary tube, excited by Mo-x-rays. The intensity of sharp $CuK\alpha$ Kossel photon beam from Cu(111) face pumped by Mo-x-ray increases due to increase in inducing $CuK\alpha$ fluorescence radiation from the Cu capillary tube. X-rays from Mo tube pass through collimator and strike the Cu single crystal face (111) at the Bragg angle 21°39'.

Similar results of sharp $CuK\alpha_1$ line are obtained when a single crystal of Cu(111) is pumped by x-rays from an Ag target x-ray tube through a narrow copper capillary tube as collimator.

A binary alloy of Cu and Mo or Cu and Ag in atomic proportions as targets will increase the intensity of the monochromatic $CuK\alpha_1$ beam to be used in applications of x-ray diffraction, x-ray microprobe, x-ray imaging, and in x-ray mammography.

The primary binary alloy target excited by a sharp line focus electron beam is made of elemental metals Z and Z' in atomic weight proportions. The major collimated beam from the alloy target (Z,Z') play simultaneously two major roles. These are:

1. X-rays from metal Z' satisfy the near resonance ionization of K-shell electrons of atoms of single crystal Z, the lasing crystal.

2. $CuK\alpha_1$ emitted from metal Z of the binary alloy (Z,Z') has the identical frequency of $CuK\alpha_1$ of the lasing crystal Z. Therefore collimated x-rays from binary (Z,Z') target stimulate emission of $CuK\alpha_1$ from the excited surface layer at 1 to 100 micron depth of the single crystal of Cu as the second target of the x-ray tube.

Because of the near resonance condition of x-rays from metal Z' of the binary alloy target, a high rate of ionization of K-shell electrons of Z of the single lasing crystal Z is ensured. The reorganization of the high density of K-hole states ensures the creation of a high density of standing Kossel $K\alpha_1$ photon modes state stored at the surface layer of the excited single crystal of copper (Z=29). The storage of $K\alpha_1$ photons at the surface layer (1 to 100 micron depth) as Kossel photons is due to strong reflecting planes such as (111), (200), and (311) of a face centered crystal.

All $K\alpha_1$ photons stored as standing Kossel photon modes of the lasing crystal Z are directed to be emitted in a unique direction coinciding with the direction of the primary collimated x-ray beam from the binary alloy target (Z,Z'). These are stimulated $CuK\alpha_1$ x-rays from the excited single crystal Z.

In FIG. 5, the x-ray tube 130, as for example of the type seen in FIG. 2, is used for scanning mammograph purposes. The x-rays at 131 (corresponding to beams 15 or 20 in FIG. 2) pass through breast tissue 132, through a slit 132 in a screen 133, and onto an x-ray film 134. Of advantage is the elimination of unwanted x-ray scattering, for improved sensitivity of the mammograph detection technique.

The special merits of the dual target x-ray tube consisting of (a) the binary alloy target excited by a line focus electron beam and (b) the single crystal fluorescing target excited by the binary alloy target are:

need for alignment of a collimator is eliminated a highly monochromatic $k\alpha_1$ line is obtained for x-ray diffraction and x-ray imaging work a high signal to noise ratio good diffraction pictures obtained at 15KV, 10mA at 150 Watts x-ray line focus microprobe for various applications

I claim:

1. In beam generating apparatus, the combination comprising a) a first binary alloy target crystal consisting essentially of an alloy of copper and silver, for producing a primary x-ray beam, b) a second target crystal consisting essentially of copper in the path of said first x-ray beam and oriented to produce a CuK$\alpha$, radiation in response to impingement of said primary beam.

2. The combination of claim 1 wherein the proportions of said copper and silver in said first target are, in terms of atomic weight:

about 50% copper about 50% silver

3. The combination of claim 1 wherein said second target crystal consists of Cu(111).

4. The combination of claim 1 wherein said second target crystal consists of Cu(200).

5. The combination of claim 1 wherein said second target crystal has multiple lattice planes oriented at Bragg resonance angle $\Theta_b$ relative to the direction of said primary beam.

6. The combination of claim 1 wherein said second target crystal has a planar surface angled relative to the direction of impingement of said primary beam to receive said impingement.

7. The combination of claim 1 including collimating means for collimating said primary x-ray beam.

8. The combination of claim 5 wherein said second target consists of Cu(111) and said Bragg resonance angle is 22°39'.

9. The combination of claim 5 wherein said second target consists of Cu(200) and said Bragg resonance angle is 25°39'.

10. The combination of claim 1 wherein said second target is oriented to produce Kossel radiation directed at angle $\Theta_b$ relative to said face, and Borrmann radiation directed at angle $2\Theta_b$ relative to said face.

11. The combination of claim 10 wherein said copper is Cu(111) and said angle $\Theta_b$ is 21°39' and said angle $\Theta_b$ is 43°18'.

12. The combination of claim 10 wherein said copper is Cu(200) and said angle $\Theta_b$ is 25°13', and said angle $2\Theta_b$ is 50°26'.

13. The combination of claim 10 wherein said apparatus includes an x-ray tube containing said first target, and an electron gun in said tube for producing electrons directed at said first target to produce said first beam.

14. In beam generating apparatus, the combination comprising:

a) a first multiple alloy target crystal for producing i) a primary x-ray beam ii) a secondary x-ray beam b) a primary target crystal in the path of said primary x-ray beam to produce Kossel radiation in a beam $K_1$, and Borrmann radiation in a beam $B_1$, c) and a secondary target crystal in the path of said secondary x-ray beam to produce Kossel radiation in a beam $K_2$ and Borrmann radiation in a beam $B_2$.

15. The combination of claim 14 wherein said primary crystal has a planar face upon Which said primary x-ray beam is incident and extending at Bragg angle $\Theta_b$ relative to said primary x-ray beam, $K_1$ extending at angle $\Theta_b$ relative to the plane of said face, and $B_1$, extending at angle $2\Theta_b$ relative to the plane of said face.

16. The combination of claim 14 wherein said secondary crystal has a planar face upon which said secondary x-ray beam is incident, and extending at Bragg angle $\Theta_b$ relative to said secondary x-ray beam, $K_2$ extending at angle $\Theta_b$ relative to the plane of said face, and $B_2$ extending at angle $2\Theta_b$ relative to the plane of said face.

17. The combination of claim 14 wherein said primary target consists of Cu(111) and said secondary target consists of Cu(200).

18. The combination of claim 17 wherein said first target consists of a binary metal alloy.

19. The combination of claim 18 wherein said binary alloy consists of metals selected from the group consisting of Cu Ag Fe Ti Cr Co Mo.

20. The combination of claim 14 wherein said apparatus includes an X-ray tube containing said first target, and an electron gun in said tube for producing electrons directed at said first target to produce said first beam.

21. The method of employing an x-ray apparatus that includes a) providing a binary alloy target crystal consisting essentially of an alloy of copper and silver, for producing a primary x-ray beam, b) passing said primary x-ray beam through a target to be scanned, and a slit, and c) then impinging said beam on an x-ray sensitive film.

22. The method of claim 21 wherein said target to be scanned is human tissue.

23. The method of claim 2 wherein mammography is carried out.

24. The method of generating CuK$\alpha$ radiation that includes a) providing a first binary alloy target crystal consisting essentially of an alloy of copper and silver, for producing a primary x-ray beam, B) and providing a second target crystal consisting essentially of copper in the path of said first x-ray beam and oriented to produce a Cuk$\alpha$, radiation in response to impingement of said primary beam.

25. In beam generating apparatus, the combination comprising a) a first binary alloy target crystal consisting of an alloy of metals Z' and Z, for producing a primary x-ray beam, b) and a second target crystal consisting of one of Z' and Z, and having an angled face in the path of said first beam, and oriented to produce Kossel radiation in response to impingement of said primary beam.

26. The apparatus of claim 25 wherein said metals Z' and Z are selected from the group consisting of Cu
Ag
Fe
Ti
Cr
Co
Mo.

* * * * *